US007493840B2

(12) United States Patent
Yamaguchi et al.

(10) Patent No.: US 7,493,840 B2
(45) Date of Patent: Feb. 24, 2009

(54) THREE-SIDE TRIMMER

(75) Inventors: Chuji Yamaguchi, Shiga (JP); Ko Ouchiyama, Shiga (JP); Masato Nogawa, Shiga (JP)

(73) Assignee: Horizon International Inc., Shiga (JP)

( * ) Notice: Subject to any disclaimer, the term of this patent is extended or adjusted under 35 U.S.C. 154(b) by 473 days.

(21) Appl. No.: 10/945,939

(22) Filed: Sep. 21, 2004

(65) Prior Publication Data

US 2005/0061135 A1 Mar. 24, 2005

(30) Foreign Application Priority Data

Sep. 22, 2003 (JP) ..... 2003-329607

(51) Int. Cl.
*B26D 5/20* (2006.01)

(52) U.S. Cl. ..... 83/276; 83/277; 83/278; 83/279; 83/280; 83/281; 83/404; 83/934; 83/733

(58) Field of Classification Search ..... 83/276–281, 83/255, 404, 407, 704, 425, 934, 425.2, 425.3, 83/733, 607, 613; 412/16
See application file for complete search history.

(56) References Cited

U.S. PATENT DOCUMENTS 5,120,178 A * 6/1992 Ito ..... 414/222.07

(Continued)

FOREIGN PATENT DOCUMENTS

JP H11-042593 2/1999

JP 2001-096489 4/2001

(Continued)

*Primary Examiner*—Boyer D Ashley
*Assistant Examiner*—Omar Flores-Sánchez
(74) *Attorney, Agent, or Firm*—Hodgson Russ LLP

(57) ABSTRACT

A three-side trimmer according to the present invention comprises a bound material feed unit (2) for feeding the bound material (1) one by one; a rotating table unit (3) for receiving the bound material (1) from the bound material feed unit (2) at a predetermined position and rotating the bound material at every predetermined angle in such a manner that the bound material is arranged at three positions of a top edge cutting position, a front edge cutting position and a bottom edge cutting position; a trimming unit (4) arranged for movement in a direction close to or away from the rotating table unit (3) between two positions of a cutting position at which the trimming unit (4) becomes close to the rotating table unit (3) so as to cut a top edge section (1*a*), a bottom edge section (1*b*) and a front edge section (1*c*) of the bound material (1), respectively, and a standby position at which the trimming unit (4) is away from the rotating table unit (3); trimming unit guide means (5) arranged between the rotating table unit (3) and the trimming unit (4); drive means (6) for moving the trimming unit (4) along the trimming unit guide means (5) between the cutting position and the stand-by position; a control unit (7) for controlling the operation of each of the rotating table unit (3), the trimming unit (4) and the drive means (6), whereby the trimming unit (4) moves from the standby position to the cutting position for cutting the top edge section (1*a*), the front edge section (1*c*) and the bottom edge section (1*b*) of the bound material (1), respectively every time the bound material (1) is arranged at the top edge cutting position, front edge cutting position and the bottom edge cutting position; and receiving position changing means for shifting the position at which the rotating table unit (3) receives die bound material (1) from the bound material feed unit (2).

5 Claims, 8 Drawing Sheets

U.S. PATENT DOCUMENTS 5,765,984 A * 6/1998 Stefano et al. ..... 414/222.08
7,131,361 B2 * 11/2006 Nakajima ..... 83/100

FOREIGN PATENT DOCUMENTS

JP 2003-071780 3/2003
JP 2003071779 12/2003

* cited by examiner

A

B

THREE-SIDE TRIMMER

FIELD OF THE INVENTION

The present invention relates to a three-side trimmer adapted to cut top and bottom edges and front edge of a bound material for finishing the binding during a book binding process, and particularly relates to a three-side trimmer adapted to cut top and bottom edges and front edge of a bound material by a single trimming cuter while rotating the bound material rotated at every predetermined angle.

BACKGROUND OF THE INVENTION

A conventional three-side trimmer of this type is disclosed in JP2003-71779A. As shown in FIG. 6, this three-side trimmer has a rotating table unit 71 that receives a bound material 70 from a bound material feed unit (not shown) at a predetermined position to be positioned there and rotates the bound material at every predetermined angle (90 degrees) in a supporting manner to arrange the bound material at three positions respectively, i.e., a top edge cutting position, front edge cutting position and bottom edge cutting position, and a trimming unit 72 that is arranged so as to be movable in a direction close to or away from the rotating table unit 71 and has a cutting position where it becomes close to the rotating table unit 71 for cutting a top edge section 70*a*, bottom edge section 70*b* and front edge section 70*c* of the bound material 70 respectively and a stand-by position where it is away from the rotating table unit 71.

The rotating table unit 71 has an top surface that can support a section of the bottom surface of the bound material 70 except for the top edge section 70*a*, bottom edge section 70*b* and the front edge section 70*c*, and has a table 73, on which the bound material 70 is placed, mounted on the top surface. The table 73 is composed of an L-shaped metal plate having a flat section on which the bound material 70 is placed and an upright section 73*a* joined to one side edge of the flat section. The upright section 73*a* of the table 73 functions as a positioning plate to which a back 70*d* of the bound material 70 contacts.

Although not shown, a vertical rotating shaft is mounted at the bottom surface of the table 73, wherein the rotating shaft is held so as to be rotatable by a bearing. Further, a motor is coupled to the rotating shaft, whereby the table 73 is rotatably driven by the motor.

Moreover, a pressure plate 74 is arranged so as to be capable of moving up and down at a position opposite to the rotating shaft above the table 73. It takes a stand-by position spaced from the bound material 70 and a working position for pressing the bound material 70 to the table 73. The pressure plate 74 can rotate at the working position with the table 73 and the bound material 70.

The trimming unit 72 is provided with a frame 75, a trimming table element 76 attached to the frame 75 and a blade receiving plate 77 fixed to the top surface of the trimming table element 76. Further, a trimming cutter 78 is arranged so as to be capable of moving up and down by a driving mechanism 79 at a position opposite to the blade receiving plate 77 above the trimming table element 76. The trimming cutter 78 takes a non-cutting position spaced from the blade receiving plate 77 and a cutting position for pressing the edge of the cutter to the blade receiving plate 77.

Although not shown, a pressure member is arranged so as to be capable of moving up and down above the trimming table element 76. It takes a first position spaced from the bound material 70 and a second position for pressing the bound material 70 to the trimming table element 76. The pressure member takes the second position when the trimming cutter 78 moves from the non-cutting position to the cutting position, while it takes the first position when the trimming cutter 78 moves from the cutting position to the non-cutting position.

The frame 75 of the trimming unit 72 is coupled to a motor 80 via a feed screw 81. The trimming unit 72 reciprocates between the cutting position and the stand-by position by the drive of the motor 80.

The operation of each of the rotating table unit 71, the trimming unit 72 and the motor 80 is controlled, whereby the trimming unit 72 moves from the stand-by position to the cutting position every time the bound material 70 is arranged at the top edge cutting position, front edge cutting position and the bottom edge cutting position, to thereby respectively cut the top edge section 70*a*, the front edge section 70*c* and the bottom edge section 70*b* of the bound material 70.

According to the conventional three-side trimmer, the bound material 70 is received from the bound material feed unit to the table 73 and positioned thereon, regardless of length-width ratio (the ratio of the length between the top edge 70*a* and the bottom edge 70*b* to the length between the front edge 70*c* and the back 70*d*), while it keeps a fixed positional relationship with respect to the rotation shaft of the table 73. FIGS. 7 and 8 are plan views for explaining this state. FIG. 7 shows a state of the movement of the bound material 70 and the trimming cutter 78 during the trimming operation of the bound material 70 of 300 mm×200 mm ((the length between the top edge 70*a* and bottom edge 70*b*)×(the length between the back 70*d* and front edge 70*c*)), while FIG. 8 shows a state of the movement of the bound material 70' and the trimming cutter 78' during the trimming operation of the bound material 70' of 200 mm×300 mm ((the length between the top edge 70*a'* and bottom edge 70*b'*)×(the length between the back 70*d'* and front edge 70*c'*)). In FIGS. 7 and 8. (A) shows a state where the bound material is positioned, while (B) shows a state where the bound material is rotated at three cutting positions respectively, wherein X represents the bound material at the top edge cutting position, Y represents the bound material at the front edge cutting position and Z represents the bound material at the bottom edge cutting position. Further, O represents the center of rotation of the table.

As easily understood from FIGS. 7 and 8, when the bound material in which the length between the top edge and the bottom edge is its short side and the length between the back and the front edge is its long side is cut, the length L of the blade of the trimming cutter 78 equals to 300 mm that is substantially the same as the length of the long side of the bound material, and further, a short moving distance of the trimming cutter 78 is enough in this construction. However, when the bound material in which the length between the top edge and the bottom edge is its long side and the length between the back and the front edge is its short side is cut, the trimming cutter 78' having the length L of the blade is 480 mm is required, and further, the moving distance of the trimming cutter 78' is required to be increased.

Specifically, in order to cut various bound materials each having a different length-width ratio in the conventional three-side trimmer, the required construction is such that a heavy trimming cutter having a long length of the blade can be moved in a long distance. With this construction, the whole structure of the three-side trimmer should be made to have greater energy consumption and to occupy much more space.

SUMMARY OF THE INVENTION

Accordingly, it is an object of the present invention to provide a three-side trimmer that supports each of various bound materials each having a different length-width ratio and causes the same to rotate at predetermined angle for cutting its top edge, bottom edge and front edge by a single trimming cutter, wherein a trimming cutter as short as possible is provided and a moving distance of the trimming cutter is reduced as much as possible, thereby providing a compact three-side trimmer having reduced energy consumption.

According to the first invention, the above object is attained by providing a three-side trimmer adapted to cut top and bottom edges and front edge of a bound material by means of a single trimming cutter while rotating the bound material at every predetermined angle, comprising: a bound material feed unit for feeding the bound material one by one; a rotating table unit for receiving the bound material from the bound material feed unit at a predetermined position and rotating the bound material at every predetermined angle in such a manner that the bound material is arranged at three positions of a top edge cutting position, a front edge cutting position and a bottom edge cutting position; a trimming unit arranged for movement in a direction close to or away from the rotating table unit between two positions of a cutting position at which the trimming unit becomes close to the rotating table unit so as to cut a top edge section, a bottom edge section and a front edge section of the bound material, respectively, and a stand-by position at which the trimming unit is away from the rotating table unit; trimming unit guide means arranged between the rotating table unit and the trimming unit; drive means for moving the trimming unit along the trimming unit guide means between the cutting position and the stand-by position; a control unit for controlling the operation of each of the rotating table unit, the trimming unit and the drive means in such a manner that the trimming unit moves from the stand-by position to the cutting position for cutting the top edge section, the front edge section and the bottom edge section of the bound material, respectively every time the bound material is arranged at the top edge cutting position, front edge cutting position and the bottom edge cutting position; and receiving position changing means for shifting the position at which the rotating table unit receives the bound material from the bound material feed unit.

According to a preferable embodiment of the first invention, the rotating table unit comprises: a base; a table provided with the top surface for supporting a section of the bottom surface of the bound material except for the top edge section, the bottom edge section and the front edge section thereon; positioning means for positioning the bound material on the top surface of the table; a vertical rotating shaft mounted at the bottom surface of the table; a bearing mounted to the base for rotatably supporting the rotating shaft; drive means for revolving the rotating shaft; a pressure plate arranged opposite to the rotating shaft above the table for upwardly and downwardly movement between two positions of a stand-by position at which the pressure plate is spaced from the bound material, and a working position at which the pressure plate presses the bound material against the table; and pressure plate drive means supported by the base for moving the pressure plate between the stand-by position and the working position, the pressure plate being attached to the pressure plate drive means for rotation about the rotating axis of the table at the working position. The trimming unit comprises: a frame; a trimming table element attached to the frame for supporting the bottom surface of the top edge section, the bottom edge section or the front edge section of the bound material placed on the table of the rotating table unit when the trimming unit takes the cutting position; a blade receiving plate fixed to the top surface of the trimming table element; a trimming cutter arranged opposite to the blade receiving plate above the trimming table element for upwardly and downwardly movement between two positions of a non-cutting position at which the trimming cutter is spaced from the blade receiving plate, and a cutting position at which the trimming cutter is pushed against the blade receiving plate at its edge; a trimming cutter drive means attached to the frame for moving the trimming cutter between the cutting position and the non-cutting position; a pressure member arranged above the trimming table element for upwardly and downwardly movement between two positions of a first position at which the pressure member is spaced from the bound material, and a second position at which the pressure member presses the bound material against the trimming table element; and pressure member drive means mounted to the frame for moving the pressure member between the first position and the second position in such a manner that the pressure member takes the second position when the trimming cutter moves from the non-cutting position to the cutting position and that the pressure member takes the first position when the trimming cutter moves from the cutting position to the non-cutting position.

According to another preferable embodiment of the first invention, the bound material feed unit comprises: a bound material loading table on which a stack of the bound materials is placed; a transporting path extending between the rotating table unit and the bound material loading table, the discharge end of the transporting path being adjacent to the rotating table unit, the supplying end of the transporting path being adjacent to the bound material loading table at its side; bound material feeding means for feeding the bound material one by one from the bound material loading table to the transporting path in a direction perpendicular to the transporting direction of the bound material; and bound material transporting means for transporting the bound material received from the bound material feeding means to the rotating table unit along the transporting path; the receiving position changing means comprising means for changing the feeding distance of the bound material to the transporting path by the bound material feeding means.

According to still another preferable embodiment, the receiving position changing means comprises means for shifting the rotating shaft of the table in the horizontal direction by moving the bearing of the rotating table unit parallel to the base before the rotating table unit receives the bound material from the bound material feed unit.

Further, in order to attain the above-mentioned object, the second invention provides a three-side trimmer adapted to cut top and bottom edges and front edge of a bound material with a single trimming cutter while rotating the bound material at every predetermined angle, comprising: a bound material feed unit for feeding the bound material one by one; a rotating table unit for receiving the bound material from the bound material feed unit at a predetermined position and rotating the bound material at every predetermined angle in such a manner that the bound material is arranged at three positions of a top edge cutting position, a front edge cutting position and a bottom edge cutting position; a trimming unit arranged for movement in a direction close to or away from the rotating table unit between two positions of a cutting position at which the trimming unit becomes close to the rotating table unit for cutting a top edge section, bottom edge section and front edge section of the bound material, respectively, and a stand-by position at which the trimming unit is away from the rotating table unit; trimming unit guide means arranged between the routing table unit and the trimming unit; drive means for moving the trimming unit along the trimming unit guide means between the cutting position and the stand-by position;

a control unit for controlling the operation of each of the rotating table unit, the trimming unit and the drive means in such a manner that the trimming unit moves from the stand-by position to the cutting position for cutting the top edge section, the front edge section and the bottom edge section of the bound material, respectively, every time the bound material is arranged at the top edge cutting position, the front edge cutting position and the bottom edge cutting position; and rotating shaft shifting means arranged at the rotating table unit for shifting the rotating axis of the bound material in the horizontal direction after the bound material is positioned to be held.

DESCRIPTION OF THE PREFERRED EMBODIMENTS

Figure 1:
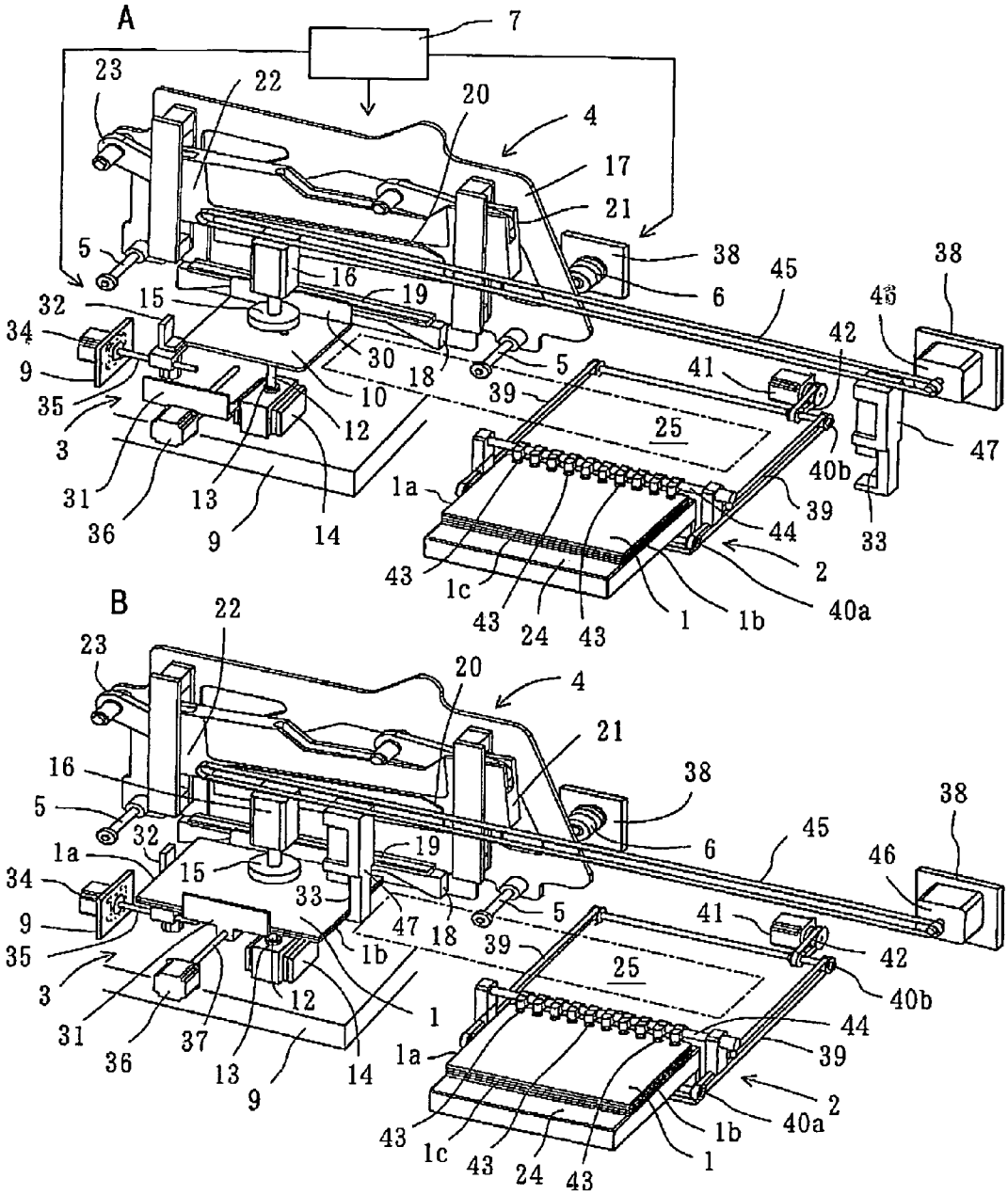
FIG. 1 is a perspective view schematically showing a construction of a three-side trimmer according to one embodiment of the present invention, wherein (A) shows a state before a bound material is fed from a bound material loading table of a bound material feed unit and (B) shows a state in which the bound material is positioned on a table of a rotating table unit.

Preferred embodiments of the present invention will be explained hereinbelow with reference to the attached drawings. FIG. 1 is a perspective view schematically showing a construction of a three-side trimmer according to one embodiment of the present invention.

Referring to FIG. 1, a three-side trimmer of the present invention is provided with a bound material feed unit 2 for feeding a bound material 1 one by one, a rotating table unit 3 for receiving the bound material 1 from the bound material feed unit 2 at a predetermined position and rotating the bound material 1 at every predetermined angle in such a manner that the bound material 1 is arranged at three positions of a top edge cutting position, a front edge cutting position and a bottom edge cutting position, and a trimming unit 4 arranged for movement in a direction close to or away from the rotating table unit 3 between two positions of a cutting position at which it becomes close to the rotating table unit 3 for cutting a top edge section 1*a*, bottom edge section 1*b* and front edge section 1*c* of the bound material 1, respectively, and a stand-by position at which it is away from the rotating table unit 3.

The rotating table unit 3 has a base 9 and a rectangular table 10 which is provided with the top surface for supporting a section of the bottom surface of the bound material 1 except for the top edge section 1*a*, bottom edge section 1*b* and the front edge section 1*c* thereon. The rotating table unit 3 also has positioning means for positioning the bound material 1 on the top surface of the table 10.

In this embodiment, the positioning means has a first upright plate 30 arranged opposite to one side edge of the table 10 and the side edge thereof perpendicular to the one side edge, wherein a back 1*d* of the bound material 1 comes in contact with the upright plate 30. The first upright plate 30 is coupled to a suitable slide driving mechanism (not shown) attached to the bottom surface of the table 10. Further, the positioning means has a second upright plate 32 to which the top edge 1*a* of the bound material 1 contacts. The second upright plate 32 is mounted to a feed screw 35 that is rotatably driven by a motor 34 supported by the base 9. In this way, the first and second upright plates 30 and 32 can move in a direction close to or away from the table 10 and they are at a standstill at a predetermined position corresponding to a size and receiving position of the bound material 1 fed from the bound material feed unit 2 (see FIG. 1(A)).

The positioning means is further provided with a third upright plate 31 arranged opposite to the first upright plate 30 with the table 10 therebetween, so that the front edge 1*c* of the bound material 1 comes in contact with the third upright plate 31. The third upright plate 31 is mounted to a feed screw 37 that is rotatably driven by a motor 36 supported by the base 9, like the second upright plate 32, so that it can move in a direction close to or away from the table 10. When the bound material 1 is placed on the table 10, the third upright plate 31 moves in a direction close to the bound material 1 until the back 1*d* of the bound material 1 comes in contact with the first upright plate 30 and the third upright plate 31 comes in contact with the front edge 1*c*. This achieves the positioning of the bound material 1 placed on the table 10 in the back-to-front direction (see FIG. 1(B)).

A face 33 of a chuck of the bound material feed unit 2 that comes in contact with the bottom edge 1*b* of the bound material 1 also functions as a part of the positioning means. It performs the positioning of the bound material 1 in the top-to-bottom direction with the second upright plate 32 (see FIG. 1(B)). This will be described later.

A vertical rotating shaft 12 is mounted at the bottom surface of the table 10 and the rotating shaft 12 is held so as to be rotatable by a bearing 13 mounted to the base 9. A motor 14 is coupled to the rotating shaft 12, whereby the table 10 is rotatably drivers by the motor 14.

A pressure plate 15 is arranged opposite to the rotating shaft 12 above the table 10 for upwardly and downwardly movement between two positions of a stand-by position at which it is spaced from the bound material 1, and a working position at which it presses the bound material 1 against the table 10. The pressure plate 15 is mounted to a piston-cylinder device 16 supported by the base 9 such that it can rotate at the working position with the table 10 and the bound material 1. It can be reciprocated between the stand-by position and the working position by the drive of the piston-cylinder device 16.

After the bound material 1 is positioned by the positioning means, the pressure plate 15 takes the working position to fix the bound material 1 to the table 10. After the pressure plate 15 takes the working position, the third upright plate 31 and the chuck (face 33) of the positioning means are separated from the bound material 1 in order not to obstruct the rotational movement of the bound material 1.

The trimming unit 4 has a frame 17. Attached to the frame 17 is a trimming table element 18. When the trimming unit 4 takes the cutting position, the trimming table element 18 supports the bottom surface of the top edge section 1*a*, the bottom edge section 1*b* or the front edge section 1*c* of the bound material placed on the table 10 of the rotating table unit 3. A blade receiving plate 19 is fixed to the top surface of the trimming table element 18.

A trimming cutter 20 is arranged opposite to the blade receiving plate 19 above the trimming table element 18 for upwardly and downwardly movement. The trimming cutter 20 takes a non-cutting position at which it is spaced from the blade receiving plate 19 and a cutting position at which it is pushed against the blade receiving plate 19 at its edge. A trimming cutter driving mechanism 21 is attached to the frame 17 for reciprocating the trimming cutter 20 between the cutting position and the non-cutting position.

A pressure member 22 is arranged above the trimming table element 18 for upwardly and downwardly movement between two positions of a first position at which it is spaced from the bound material 1 and a second position at which it presses the bound material 1 against the trimming table element 18. The pressure member 22 is reciprocated between the first position and the second position by a pressure member driving mechanism 23 in such a manner that it takes the second position when the trimming cutter 20 moves from the non-cutting position to the cutting position, while it takes the first position when the trimming cutter 20 moves from the cutting position to the non-cutting position.

Two feed screws 5 are horizontally arranged spaced apart between the rotating table unit 3 and the trimming unit 4. They are rotatably mounted to a support member (not shown) fixed to another frame (main frame) 38. The frame 17 of the trimming unit 4 is engaged with these feed screws 5. The feed screws 5 are coupled to a driving shaft of a motor 6 mounted to the frame 38, whereby the feed screws 5 are rotatably driven by the motor 6, that causes the trimming unit 4 to move between the cutting position and the stand-by position along the shaft direction of the feed screws 5.

There is provided a control unit 7 for controlling the operation of each of the rotating table unit 3, the trimming unit 4 and the motor 6 in such a manner that the trimming unit 4 moves from the stand-by position to the cutting position every time the bound material 1 is arranged at the top edge cutting position, the front edge cutting position and the bottom edge cutting position, to thereby respectively cut the top edge section 1*a*, the front edge section 1*c* and the bottom edge section 1*b* of the bound material 1.

Figure 2:
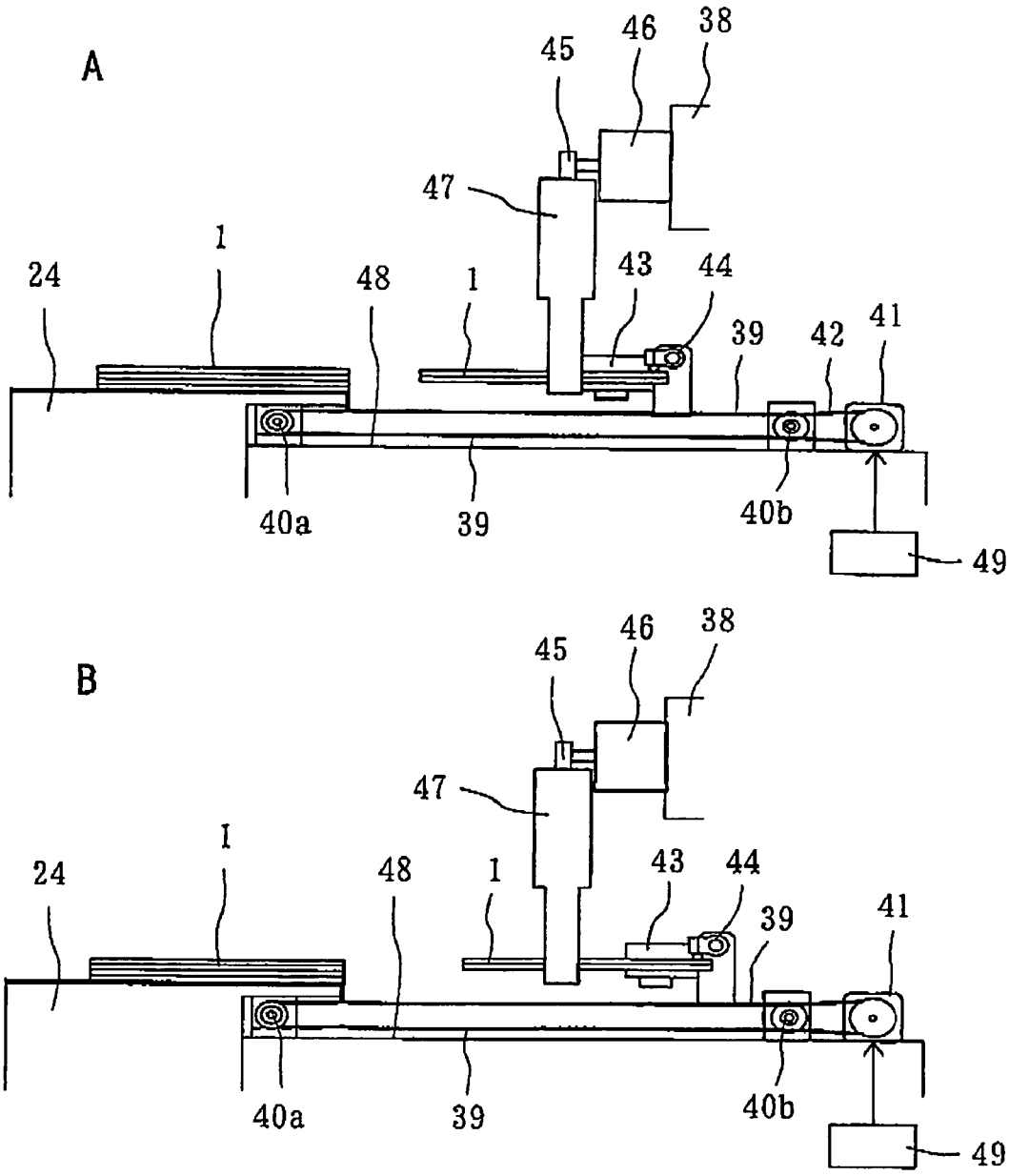
FIG. 2 is a front view of the three-side trimmer shown in FIG. 1, showing a state in which the bound material is received from a bound material feeding mechanism to a bound material transporting mechanism, wherein (A) shows a case where a feeding distance of the bound material from the bound material loading table to a transporting path is short and (B) shows a case where the feeding distance of the bound material is long.

FIG. 2 is a front view of the three-side trimmer shown in FIG. 1, showing a state in which the bound material is received from a bound material feeding mechanism to a bound material transporting mechanism. Referring to FIGS. 1 and 2, the bound material feed unit 2 has a bound material loading table 24 on which a stack of the bound materials 1 is placed. A transporting path 25 extends between the rotating table unit 3 and the bound material loading table 24. A discharge end of the transporting path 25 is adjacent to the rotating table unit 3, while a side section of a supplying end thereof is adjacent to the bound material loading table 24.

The bound material feed unit 2 also has a bound material feeding mechanism that feeds the bound material 1 from the bound material loading table 24 to the transporting path 25 one by one in the direction perpendicular to the transporting direction of the bound material. The bound material feeding mechanism has a pair of endless belts 39 extending in the direction right-angled to the transporting path 25 from both sides of the bound material loading table 24 across the transporting path 25, and rollers 40*a* and 40*b* to which both ends of the endless belts 39 are bridged. The rollers 40*a* and 40*b* are rotatably mounted around a shaft of a frame 48. Further, the roller 40*b* is coupled to a driving shaft of a motor 41 fixed to the frame 48 via an endless belt 42 for functioning as a drive roller. A support bar 44 having substantially a reverse U-shape is mounted to the pair of the endless belts 39. Suction heads 43 are mounted downwardly to the support bar 44 to have a space therebetween in its lengthwise direction. In this way, a line of the suction heads 43 reciprocates between the bound material loading table 24 and the transporting path 25 along the direction right-angled to the transporting path 25 by the drive of the motor 41.

The bound material feed unit 2 also has a bound material transporting mechanism that transports the bound material 1 received from the bound material feeding mechanism on the transporting path 25 to the rotating table unit 3 along the transporting path 25. The bound material transporting mechanism has an endless belt 45 extending along the transporting path 25 above the transporting path 25 and rotatably supported by a frame 38. The endless belt 45 is rotatably driven by a motor 46 mounted to the frame 38. Fixed in a hanging manner to the endless belt 45 is a chuck 47 that reciprocates between the bound material loading table 24 and the table 10 on the transporting path 25 by the drive of the motor 46.

As described above, the bound material 1 placed on the bound material loading table 24 is absorbed one by one by the line of the suction heads 43, and then, it is fed in the direction right-angled to the transporting direction of the bound material 1 to the transporting path 25 with its back 1*d* as a head. The bound material 1 is gripped by the chuck 47 at this position as shown in FIG. 2. In this case, the face 33 of the chuck 47 comes in contact with the bottom edge 1*b* of the bound material 1. Then, the absorption by the line of the suction heads 43 is released, whereby the bound material 1 is transferred to the chuck 47. Thereafter, the chuck 47 moves toward the rotating table unit 3 on the transporting path 25, and when the point 1*a* of the bound material 1 comes in contact with the second upright plate 32, it stops. This positions the bound material 1 on the table 10 in the top-to-bottom direction.

The present invention is further provided with receiving position changing means that shifts the position where the rotating table unit 3 receives the bound material 1 from the bound material feed unit 2. In this embodiment, the receiving position changing means is composed of a control section 49 that changes a feeding distance of the bound material 1 on the transporting path 25 by the bound material feeding mechanism by controlling the drive of the motor 41. FIG. 2(A) shows the case where the feeding distance of the bound material from the bound material loading table to the transporting path is short, while FIG. 2(B) shows the case where the feeding distance of the bound material is long.

Figure 3:
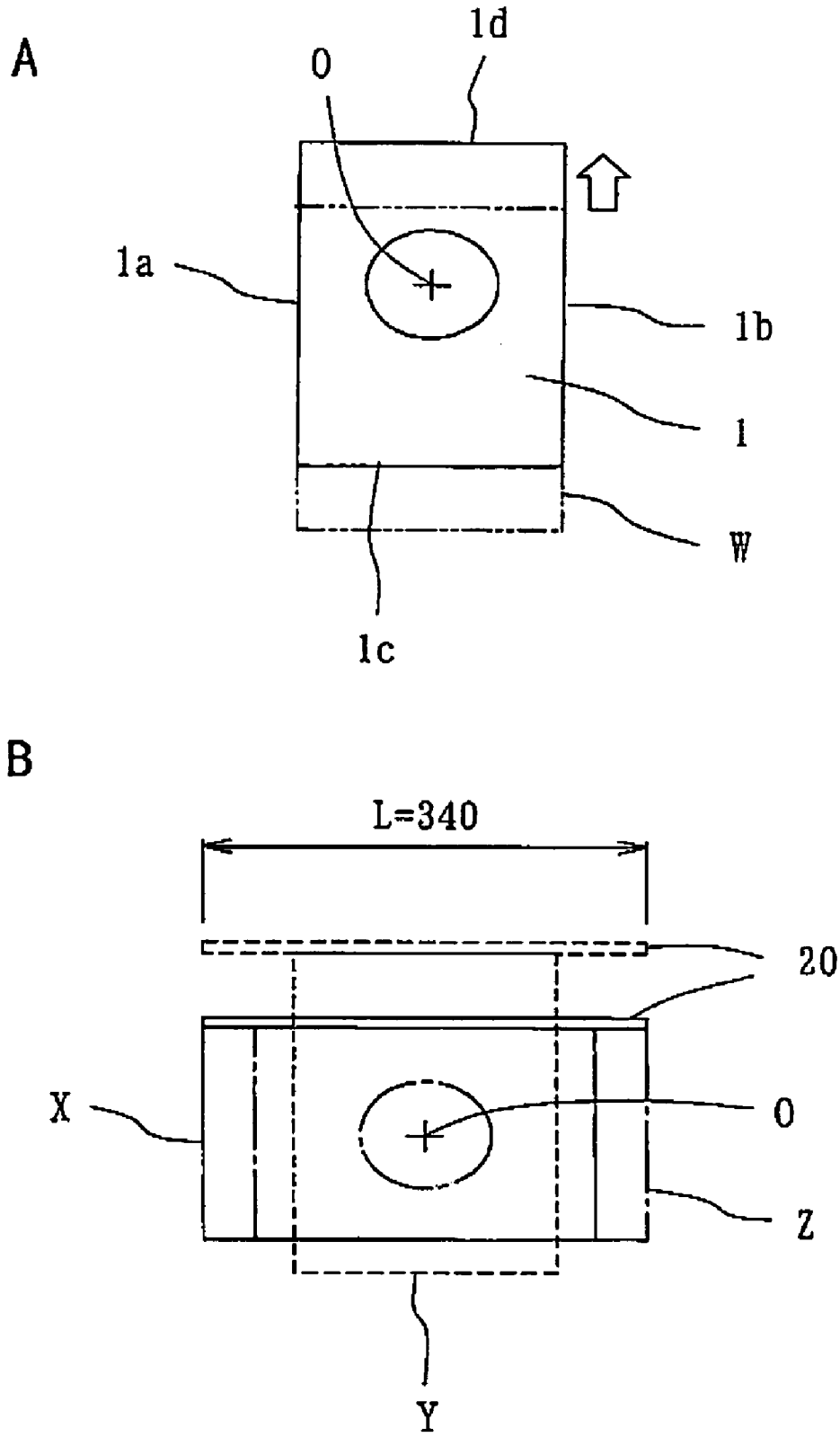
FIG. 3 is a plan view showing a state in which, in the three-side trimmer shown in FIG. 1, the bound material is rotated to be positioned at a top edge cutting position, a front edge cutting position and a bottom edge cutting position, to thereby be cut, wherein (A) shows a state in which the bound material is positioned and (B) shows a state in which the bound material is rotated at three cutting positions respectively.

FIG. 3 is a plan view showing a state in which, in the three-side trimmer in this embodiment, the bound material (200 mm×300 nm, (top 1*a*, bottom 1*b*)×(back 1*d*, front 1*c*)) is rotated to be positioned at a top edge cutting position, a front edge cutting position and a bottom edge cutting position, to thereby be cut, wherein (A) shows a state in which the bound material is positioned and (B) shows a state in which the bound material is rotated at three positions respectively. In FIG. 3(A), W (a section encircled by a two-dot-chain line) represents the receiving position of the bound material before the feeding distance is changed by the control section 49 (receiving position changing means) and a solid line represents the receiving position of the bound material 1 after the feeding distance is changed. In FIG. 3(B), X represents the bound material at the top edge cutting position, Y represents the bound material at the front edge cutting position and Z represents the bound material at the bottom edge cutting position. Further, O represents the center of rotation of the bound material in FIGS. 3(A) and 3(B). As easily understood from the comparison between FIG. 3 and FIG. 8, the three-side trimmer of the present invention can shorten the size of the blade of the trimming cutter (L=340 mm) and can further shorten the moving distance of the trimming cutter, compared to the conventional one.

In this embodiment, the feeding distance of the bound material 1 from the bound material loading table 24 in the bound material feed unit 2 is changed, resulting in changing the receiving position of the bound material 1 at the rotating table unit 3. However, in another embodiment not shown, the bearing 13 of the rotating table unit 3 is moved parallel to the base 9, before the rotating table unit 3 receives the bound material 1 from the bound material feed unit 2, without changing the feeding distance of the bound material, whereby the rotating shaft 12 of the table 10 is shifted in the horizontal direction. Consequently, the receiving position of the bound material at the rotating table unit 3 is changed.

Figure 4:
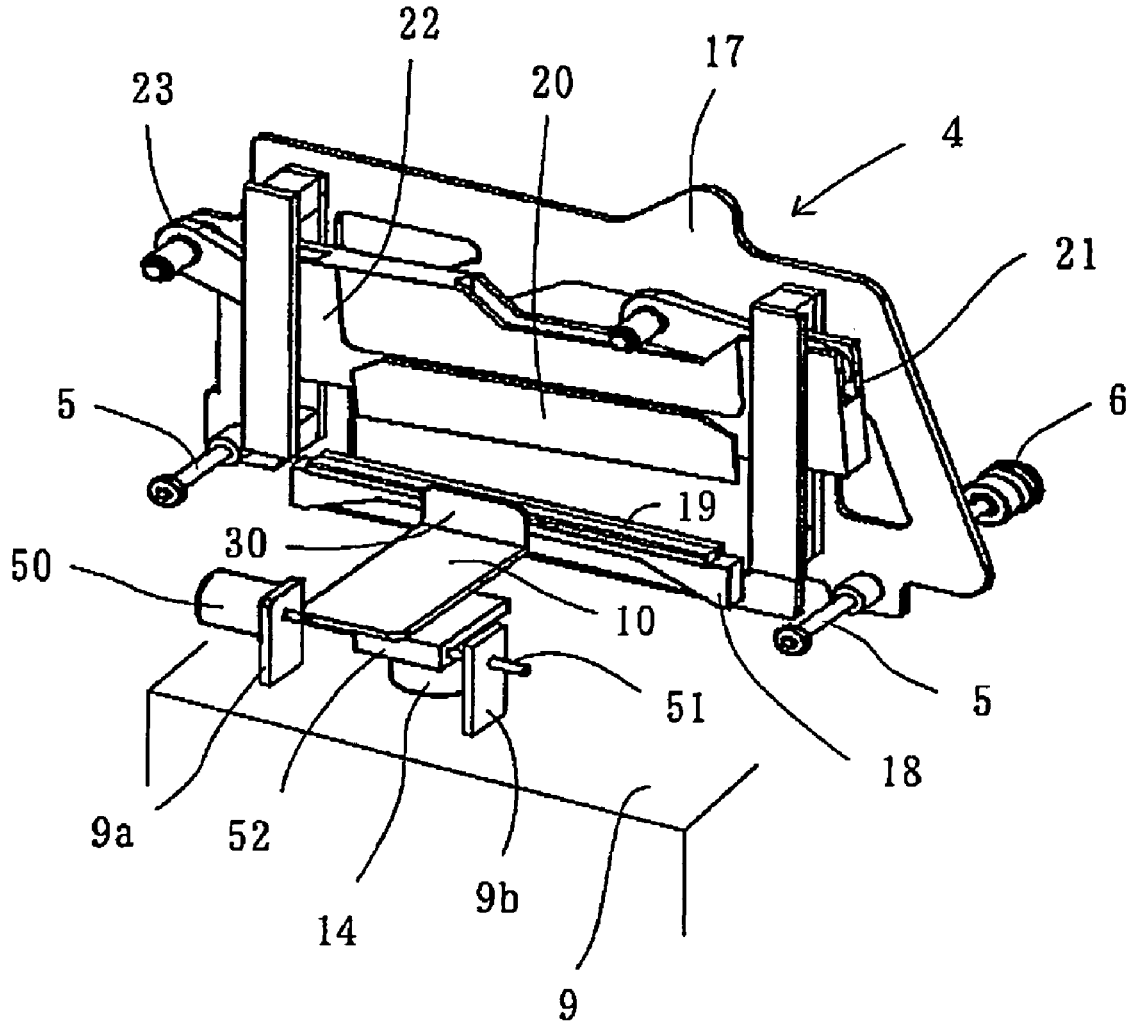
FIG. 4 is a perspective view schematically showing a construction of an essential part of a three-side trimmer according to another embodiment of the present invention.

FIG. 4 is a perspective view schematically showing a construction of an essential part of a three-side trimmer according to another embodiment of the present invention. The embodiment shown in FIG. 4 is different from that shown in FIG. 1 in that the latter one shifts the receiving position of the bound material 1 when the rotating table unit 3 receives the bound material 1 from the bound material feed unit 2, while the former one shifts the rotating shaft, that rotates the bound material 1, in the horizontal direction after the rotating table unit 3 receives to hold the bound material 1. Therefore, the components in FIG. 4 same as those in FIG. 1 are given same numerals to omit detailed explanation.

Referring to FIG. 4, a bearing (not shown) that rotatably supports a rotating shaft (not shown) of the table 10 is fixed to a movable block 52 in the rotating table unit 3 in this embodiment. The movable block 52 has a through hole provided with a thread groove. A feed screw 51 extending parallel to the trimming cutter 20 of the trimming unit 4 is engaged with this through hole. The feed screw 51 is mounted so as to be rotatable around the shaft of the base 9 by support members 9*a* and 9*b*. Further, a motor 14 that rotatably drives the rotating shaft of the table 10 is fixed to the movable block 52 so as to be capable of moving with the movable block 52. Moreover, a motor 50 is fixed to the support member 9*a*, wherein the drive shaft of the motor 50 is coupled to the feed screw 51. The drive of the motor 50 reciprocates the movable block 52, with which the rotating shaft of the table 10 reciprocates along the trimming cutter 20 in the horizontal direction.

Figure 5:
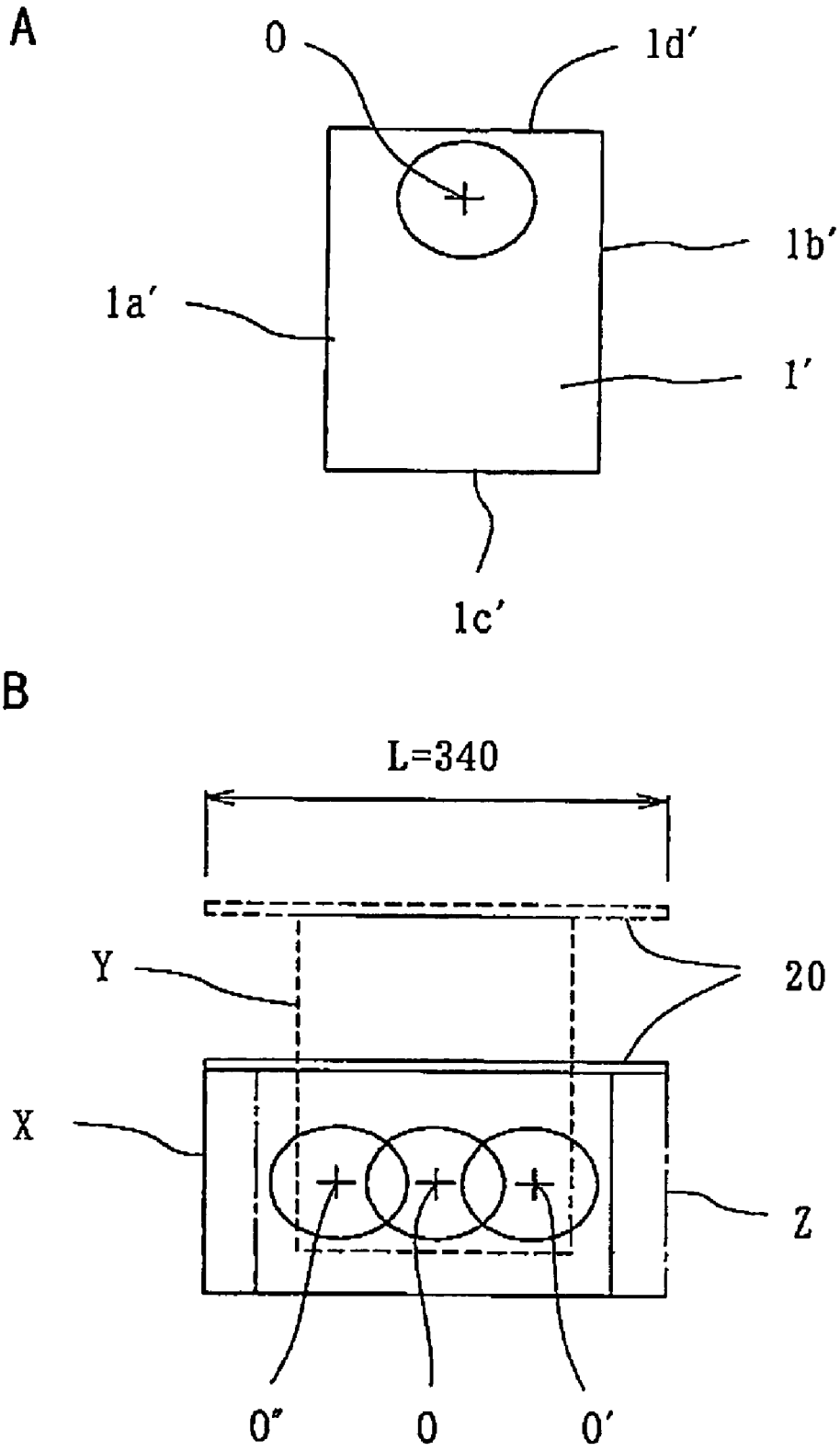
FIG. 5 is a plan view showing a state in which, in the three-side trimmer shown in FIG. 4, the bound material is rotated to be positioned at a top edge cutting position, a front edge cutting position and a bottom edge cutting position, to thereby be cut, wherein (A) shows a state in which the bound material is positioned and (B) shows a state in which the bound material is rotated at three cutting positions respectively.
Figure 6:
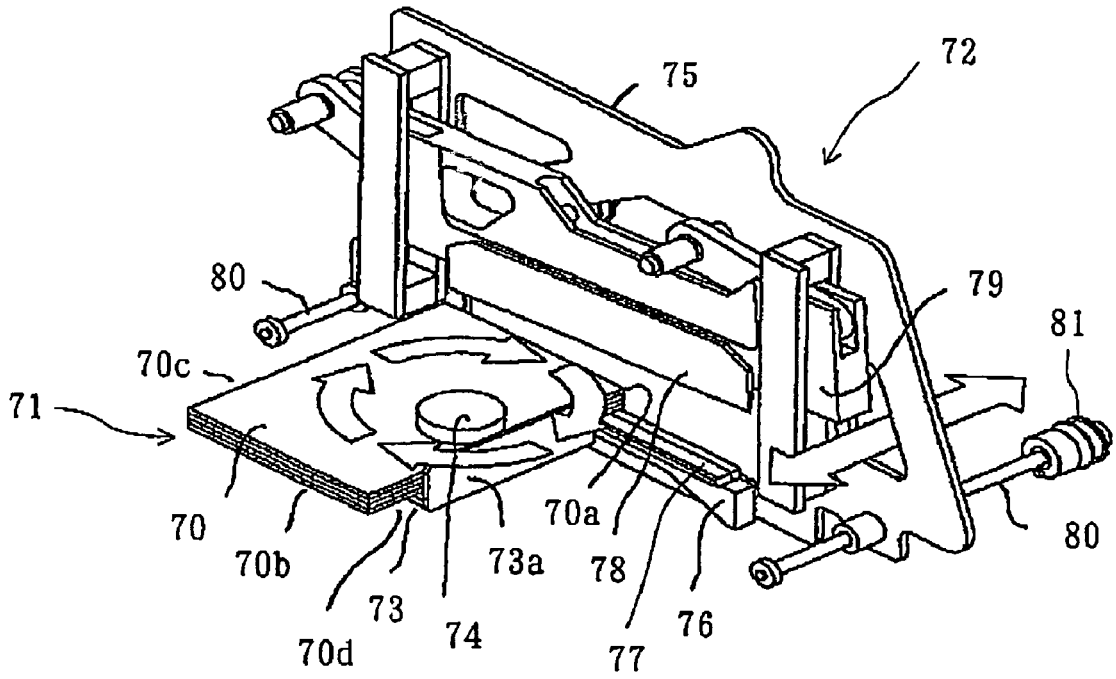
Fig. 6 (PRIOR ART)
FIG. 6 is a perspective view schematically showing a construction of a conventional three-side trimmer.
Figure 7:
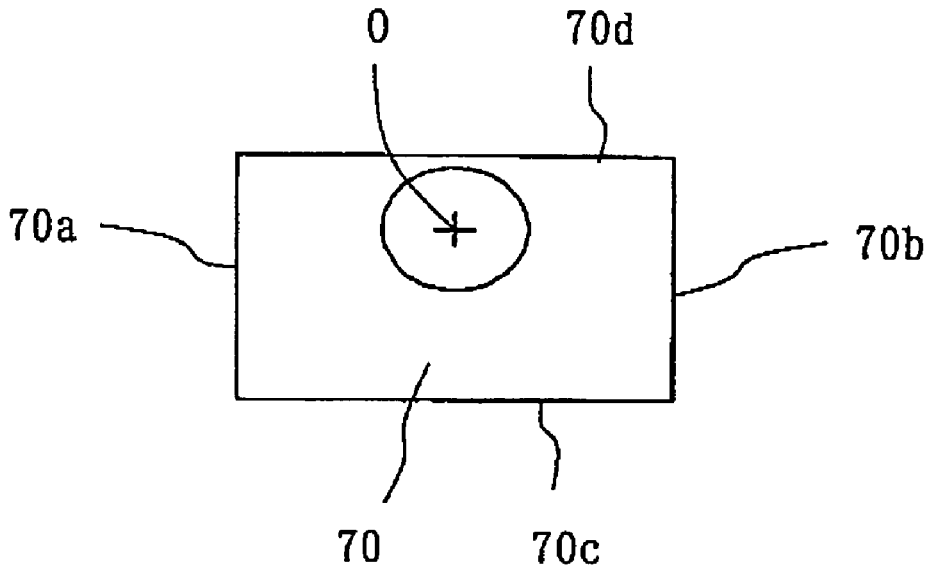
Fig. 7 (PRIOR ART)
FIG. 7 is a plan view showing a state in which, in the three-side trimmer shown in FIG. 6, the bound material is rotated to be positioned at a top edge cutting position, a front edge cutting position and a bottom edge cutting position, to thereby be cut, wherein (A) shows a state in which the bound material is positioned and (B) shows a state in which the bound material is rotated at three cutting positions respectively.
Figure 7:
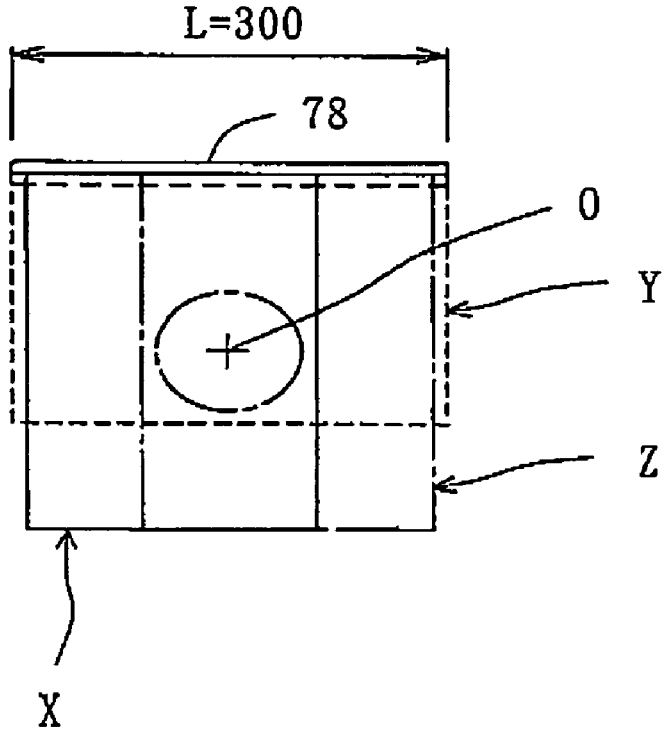
Fig. 7 (PRIOR ART)

In this embodiment, the rotating shaft for rotating the bound material 1 is shifted in the horizontal direction every time the bound material 1 held on the table 10 is arranged at the top edge cutting position, front edge cutting position and the bottom edge cutting position. FIG. 5 is a plan view for explaining this state. FIG. 5(A) shows the case where the bound material 1' (200 mm×300 mm, (top 1*a*', bottom 1*b*')×(back 1*d*', front 1*c*')) is positioned, while FIG. 5(B) shows the case where the bound material 1' is rotated at three cutting positions respectively. In FIG. 5(B), X represents the bound material at the top edge cutting position, Y represents the bound material at the front edge cutting position and Z represents the bound material at the bottom edge cutting position. Further, O', O and O" respectively represent the center of rotation of the bound material at the top edge cutting position, front edge cutting position and bottom edge cutting position.

Figure 8:
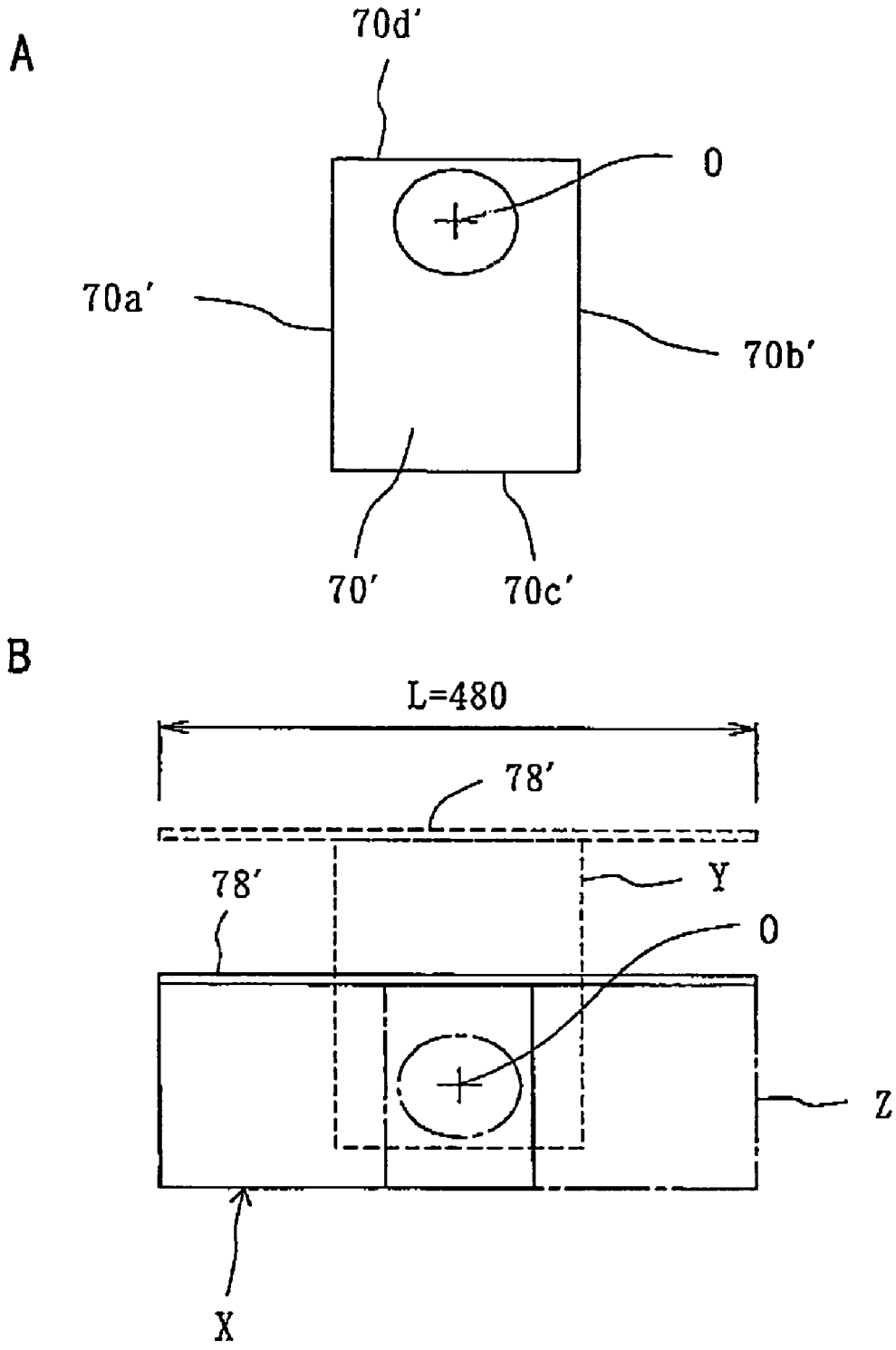
Fig. 8 (PRIOR ART)
FIG. 8 is a plan view showing a state in which, in the three-side trimmer shown in FIG. 6, another bound material is rotated to be positioned at a top edge cutting position, a front edge cutting position and a bottom edge cutting position, to thereby be cut, wherein (A) shows a state in which the bound material is positioned and (B) shows a state in which the bound material is rotated at three cutting positions respectively.

As easily understood from the comparison between FIG. 5 and FIG. 8, the three-side trimmer of the present invention can shorten the size of the blade of the trimming cutter (L=340 mm) and can further shorten the moving distance of the trimming cutter, compared to the conventional one.

As described above, the present invention uses a trimming cutter that is shorter than the conventional one and moves the trimming cutter in a short distance, whereby a bound material of various type having different length-width ratio (a ratio of a length between its top and bottom to a length between its front and back) is supported and rotated at every predetermined angle, thereby being capable of trimming its cop edge, bottom edge and front edge. Accordingly, the present invention can provide a compact three-side trimmer having reduced energy consumption.

What is claimed is:

1. A three-side trimmer adapted to cut top and bottom edges (1*a*, 1*b*) and front edge (1*c*) of a bound material (1) by means of a single trimming cutter while rotating the bound material (1) at every predetermined angle, comprising:

a bound material feed unit (2) for feeding the bound material (1) one by one;

a rotating table unit (3) having a table (10) for receiving the bound material (1) from said bound material feed unit (2) at a predetermined position and rotating the bound material at every predetermined angle in such a manner that the bound material is arranged at three positions of a top edge cutting position, a front edge cutting position and a bottom edge cutting position;

a trimming unit (4) arranged for movement in a direction close to or away from said rotating table unit (3) between two positions of a cutting position at which said trimming unit (4) becomes close to said rotating table unit (3) so as to cut a top edge section (1*a*), a bottom edge section (1*b*) and a front edge section (1*c*) of the bound material (1), respectively, and a stand-by position at which said trimming unit (4) is away from said rotating table unit (3);

trimming unit guide means (5) arranged between said rotating unit (3) and said trimming unit (4);

drive means (6) for moving said trimming unit (4) along said trimming unit guide means (5) between said cutting position and said stand-by position;

a control unit (7) for controlling the operation of each of said rotating table unit (3), said trimming unit (4) and said drive means (6) in such a manner that said trimming unit (4) moves from said stand-by position to said cutting position for cutting the top edge section (1*a*), the front edge section (1*c*) and the bottom edge section (1*b*) of the bound material (1), respectively every time the bound material (1) is arranged at said top edge cutting position, said front edge cutting position and said bottom edge cutting position, said three-side trimmer characterized by receiving position changing means for horizontally shifting the position at which the table (10) of said rotating table unit (3) receives the bound material (1) from said bound material feed unit (2).

2. The thee-side trimmer according to claim 1, wherein said rotating table unit (3) comprises:

a base (9);

a table (10) provided with the top surface for supporting a section of the bottom surface of the bound material (1) except for the top edge section (1*a*), the bottom edge section (1*b*) and the front edge section (1*c*) thereon;

positioning means (30 to 33) for positioning the bound material (1) on the top surface of said table (10);

a vertical rotating shaft (12) mounted at the bottom surface of said table (10);

a bearing (13) mounted to said base (9) for rotatably supporting said rotating shaft (12);

a drive means (14) for revolving said rotating shaft (12);

a pressure plate (15) arranged opposite to said rotating shaft (12) above said table (10) for upwardly and downwardly movement between two positions of a stand-by position at which said pressure plate (15) is spaced from the bound material (1), and a working position at which said pressure plate (15) presses the bound material (1) against said table (10); and pressure plate drive means (16) supported by said base (9) for moving said pressure plate (15) between said stand-by position and said working position, said pressure plate (15) being attached to said pressure plate drive means (16) for rotation about the rotating axis of said table (12) at said working position, and said trimming unit (4) comprises:

a frame (17);

a trimming table element (18) attached to said frame (17) for supporting the bottom surface of the top edge section (1*a*), the bottom edge section (1*b*) or the front edge section (1*c*) of the bound material (1) placed on said table (10) of said rotating table unit (3) when said trimming unit (4) takes said cutting position;

a blade receiving plate (19) fixed to the top surface of said trimming table element (18);

a trimming cutter (20) arranged opposite to said blade receiving plate (19) above said trimming table element (18) for upwardly and downwardly movement between two positions of a non-cutting position at which said trimming cutter (20) is spaced from said blade receiving plate (19), and a cutting position at which said trimming cutter (20) is pushed against said blade receiving plate (19) at its edge;

a trimming cutter drive means (21) attached to the frame (17) for moving said trimming cutter (20) between the cutting position and the non-cutting position;

a pressure member (22) arranged above said trimming table element (18) for upwardly and downwardly movement between two positions of a first position at which said pressure member (22) is spaced from the bound material (1), and a second position at which said pressure member (22) presses the bound material (1) against said trimming table element (18); and pressure member drive means (23) mounted to said frame (17) for moving said pressure member (22) between said first position and said second position in such a manner that said pressure member (22) takes said second position when said trimming cutter (20) moves from said non-cutting position to said cutting position and that said pressure member (22) takes said first position when said trimming cutter (20) moves from said cutting position to said non-cutting position.

3. The three-side trimmer according to claim 1, wherein said bound material feed unit (2) comprises:

a bound material loading table (24) on which a stack of the bound materials (1) is placed;

a transporting path (25) extending between said rotating table unit (3) and said bound material loading table (24), the discharge end of said transporting path (25) being adjacent to said rotating table unit (3), the supplying end of said transporting path (25) being adjacent to said bound material loading table (24) at its side;

bound material feeding means (39 to 44) for feeding the bound material (1) one by one from said bound material loading table (24) to said transporting path (25) in a direction perpendicular to the transporting direction of the bound material (1); and bound material transporting means (45 to 47) for transporting the bound material (1) received from said bound material feeding means (39 to 44) to said rotating table unit (3) along said transporting path (25);

said receiving position changing means comprising means (49) for changing the feeding distance of the bound material (1) to said transporting path (25) by said bound material feeding means (39 to 44).

4. The three-side trimmer according to claim 2, wherein said receiving position changing means comprises means for shifting said rotating shaft (12) of said table (10) in the horizontal direction by moving said bearing (13) of said rotating table unit (3) parallel to said base (9) before said rotating table unit (3) receives the bound material (1) from said bound material feed unit (2).

5. The three-side trimmer according to claim 2, wherein said bound material feed unit (2) comprises:

a bound material loading table (24) on which a stack of the bound materials (1) is placed;

a transporting path (25) extending between said rotating table unit (3) and said bound material loading table (24), the discharge end of said transporting path (25) being adjacent to said rotating table unit (3), the supplying end of said transporting path (25) being adjacent to said bound material loading table (24) at its side;

bound material feeding means (39 to 44) for feeding the bound material (1) one by one from said bound material loading table (24) to said transporting path (25) in a direction perpendicular to the transporting direction of the bound material (1); and bound material transporting means (45 to 47) for transporting the bound material (1) received from said bound material feeding means (39 to 44) to said rotating table unit (3) along said transporting path (25);

said receiving position changing means comprising means (49) for changing the feeding distance of the bound material (1) to said transporting path (25) by said bound material feeding means (39 to 44).

* * * * *